US005884589A

United States Patent [19]

Sakamoto et al.

[11] Patent Number: 5,884,589

[45] Date of Patent: Mar. 23, 1999

[54] COOLING APPARATUS FOR HEAT EXCHANGER

[75] Inventors: Yuichi Sakamoto; Ichiro Hirami, both of Ibaraki-Ken; Yoshihiro Kato, Yokohama; Tamio Komatsubara, Fujisawa, all of Japan

[73] Assignee: Hitachi Construction Machinery Co., Ltd., Tokyo, Japan

[21] Appl. No.: 750,253

[22] PCT Filed: Apr. 9, 1996

[86] PCT No.: PCT/JP96/00968

§ 371 Date: Mar. 21, 1997

§ 102(e) Date: Mar. 21, 1997

[87] PCT Pub. No.: WO96/32575

PCT Pub. Date: Oct. 17, 1996

[30] Foreign Application Priority Data

Apr. 10, 1995 [JP] Japan ..... 7-110014

[51] Int. Cl.[6] ..... F01P 11/10; F01P 5/02

[52] U.S. Cl. ..... 123/41.49

[58] Field of Search ..... 123/41.49

[56] References Cited

U.S. PATENT DOCUMENTS

| | | | |
|---|---|---|---|
| 3,799,128 | 3/1974 | Small | 123/41.49 |
| 3,903,960 | 9/1975 | Beck et al. | 123/41.49 |
| 3,937,189 | 2/1976 | Beck | 123/41.49 |
| 4,173,995 | 11/1979 | Beck | 123/41.49 |
| 4,685,513 | 8/1987 | Longhouse et al. | 123/41.49 |
| 5,183,382 | 2/1993 | Carroll | 123/41.49 |
| 5,590,624 | 1/1997 | Edmond et al. | 123/41.49 |

FOREIGN PATENT DOCUMENTS

| | | | |
|---|---|---|---|
| 25 08 903 | 9/1979 | Germany | 123/41.49 |
| 58-18023 | 7/1981 | Japan . | |
| 1-95596 | 6/1989 | Japan . | |
| 3-11114 | 1/1991 | Japan . | |
| 3-56898 | 5/1991 | Japan . | |
| 4-269326 | 9/1992 | Japan . | |
| 6-241045 | 8/1994 | Japan . | |
| 7-11956 | 1/1995 | Japan . | |
| 7-77044 | 3/1995 | Japan . | |
| 7-83198 | 3/1995 | Japan . | |

*Primary Examiner*—Marguerite McMahon
*Attorney, Agent, or Firm*—Fay,Sharpe,Beall, Fagan,Minnich & McKee

[57] ABSTRACT

A cooling apparatus for a heat exchanger is used for the heat exchanger of an engine mounted on a hydraulic shovel machine and the like. This cooling apparatus has a fan rotated by the engine and a shroud accommodating the fan. The fan is a type of axial fan. The shroud has a fan surrounding part with a bell-mouth form and, with respect to the shape of the fan surrounding part, a covering rate defined on the basis of the relative positional relationship between the fan surrounding part and the width of a blade is set to be included in the range of 41–70 percent.

11 Claims, 11 Drawing Sheets

PRIOR ART

PRIOR ART

COOLING APPARATUS FOR HEAT EXCHANGER

TECHNICAL FIELD

The present invention relates to a cooling apparatus for a heat exchanger, and more particularly, to a cooling apparatus suitable for a heat exchanger applied to an engine mounted on an earth-moving/construction machine such as a hydraulic shovel machine.

BACKGROUND OF THE INVENTION

FIG. 9 shows a first example of a conventional cooling apparatus used for a heat exchanger, that is, a cooling apparatus for a radiator. This cooling apparatus has been illustrated in JP-A-58-18023 (UM). In FIG. 9, a radiator 81 normally mounted on a Diesel engine (not shown) is utilized for exchanging heat between the Diesel engine and cooling water flowing in the internal part of the radiator 81 in order to cool the Diesel engine. The radiator 81 has a fan 83 for producing an airflow 82 and a shroud 84 for leading the airflow 82 to the body of the radiator 81. The fan 83 is a type of axial fan. The shroud 84 has a cylindrical opening portion 84*a* for introducing air from the outside, a cylindrical/four-cornered housing 84*b* connected to the cylindrical opening portion 84*a*, and a four-cornered ring edge portion 84c connected to both the housing 84*b* and the body of the radiator 81. The housing 84*b* is formed so that an area of an opening thereof in transverse cross section to its axis expands exponentially from the opening portion 84*a* to the edge portion 84*c*. Accordingly, the shape of the cylindrical/four-cornered housing 84*b* is nearly the horn-shape of a quadrangular pyramid. The fan 83 is disposed in the internal space of the cylindrical opening portion 84a of the shroud 84. The fan 83 is rotated by a rotation-drive unit (not shown) so as to produce the airflow 82 based on drawing air from the outside. The airflow 82 can be gradually expanded in accordance with the shape of the housing 84*b*, which causes turbulence generated in the airflow 82 to decrease. The shape of the housing 84*b* makes the rate of the airflow 82 at every point inside thereof nearly uniform.

In the above-mentioned cooling apparatus for the radiator, the shape of the opening portion 84*a* close to the end of the fan-blades is formed to be cylindrical. Consequently, the conventional cooling apparatus for the radiator has a large air-passing resistance at the opening portion 84*a*. When rotating the fan 83 at the conventional rotating speed, the large air-passing resistance reduces the amount of the airflow and therefore brings a problem such that the conventional cooling apparatus cannot cool the Diesel engine effectively.

FIG. 10 shows a second example of a conventional cooling apparatus for the radiator. This type of cooling apparatus has been illustrated in JP-A-4-269326. In this cooling apparatus, a fan 92 is disposed near to a radiator 91 and rotated by an engine 93. A shroud 94 is arranged for enclosing and accommodating the fan 92 in the space between the radiator 91 and the engine 93. The fan 92 is a type of inclined axial fan provided with a taper hub. A part 94*a* of the shroud 94, which is near to the respective pointed ends of a plurality of blades 92*a* and surrounds the fan 92, has a bell-mouth form. This part 94*a* is hereinafter referred to as "a fan surrounding part 94*a*". The bell-mouth form of the fan surrounding part 94*a* is such that a radius thereof is gradually decreased as advancing from the left and right end portions to the middle portion, and hence there is a smallest radius at a specified point. That is, the fan surrounding part 94*a* is like a cylindrical body whose middle portion is drawn in toward its inside direction.

Here, when the width of the blade 92*a* of the fan 92 is $L_1$ and the distance between the smallest radius portion and the radiator-side portion of the fan surrounding part 94*a* is $L_2$, as shown in FIG. 10, a ratio given by $L_2/L_1$ is defined as "a covering rate" which is expressed by a ratio or a percentage. The covering rate in the conventional cooling apparatus used for the radiator illustrated in JP-A-4-269326 was set to be 40% as an optimum value (with the permissible range from +10% to −20%).

In the second example of the conventional cooling apparatus for a radiator, the inclined axial fan has been used to generate a large flow of cooling air with a high pressure, and further the covering rate thereof has been set to be the most suitable value in order to achieve the highest cooling ability of the inclined axial fan. In accordance with the configurations of the second example, the problems in the first example of the conventional cooling apparatus can be solved.

However, in the second example of the conventional cooling apparatus, since an inclined axial fan is used as the fan 92, there is a problem that the brake horsepower of the fan 92 increases and the fuel expenses of the engine 93 rise.

Furthermore, in the second example of the conventional cooling apparatus, it is required to reduce a clearance (hereinafter referred to as "clearance") between the fan 92 and the fan surrounding part 94*a* of the shroud 94 in order to get sufficient cooling ability from the fan 92. When the clearance is relatively small, it is desirable that the shroud 94 is installed on the engine 93 equipped with the fan 92 rather than on the radiator 91 in order to maintain the clearance appropriately. The configuration concerning the clearance is clearly determined by the positional relationship between the fan 92 and the fan surrounding part 94*a*, and therefore the clearance can be suitably realized by installing the shroud 94 and the fan 92 on the common member. In other words, when fixing the shroud 94 to the radiator 91, it will be difficult to realize the suitable clearance because there is a possibility of producing an error due to practical installation of the radiator 91 and the engine 93. Then, in the second example, the shroud 94 is installed on the engine 93 by the part 94*b* of the shroud 94 extending to the engine 93. This configuration of the second example, however, poses a problem that the working efficiency in assembling the cooling apparatus is decreased and the production cost thereof is increased.

A main object of the present invention is to provide a cooling apparatus for a heat exchanger in which the brake horsepower of the fan can be suitably decreased and the fuel expenses of the engine can be sufficiently reduced.

Another object of the present invention is to provide a cooling apparatus for a heat exchanger in which assembly work efficiency can be increased and production cost can be decreased.

Another object of the present invention is to provide a cooling apparatus for a heat exchanger in which a shape of a fan surrounding part in a shroud is most suitable and a maximum of cooling ability can be attained.

Another object of the present invention is to provide a heat exchanger having a shroud which serves as a part of a cooling apparatus, in which the configuration of the shroud can reduce fuel expenses of an engine and the production cost and improve working efficiency of assembling the cooling apparatus.

DISCLOSURE OF THE INVENTION

A cooling apparatus for a heat exchanger according to the present invention has a fan for generating an airflow for cooling the heat exchanger, a drive unit for rotating the fan, and a shroud for accommodating the fan, and in the configuration, the fan is a type of axial fan and the shroud has a fan surrounding part with a bell-mouth form, and further, with respect to the fan surrounding part, a covering rate of the fan surrounding part is included within a range from 41 percent to 70 percent. Data of the desirable range on the covering rate was obtained by experiments.

The cooling apparatus is used for cooling the heat exchanger installed on an engine mounted on a hydraulic shovel, for example. In the cooling apparatus, a cooling airflow is produced by rotating the fan, the cooling airflow passes through air passages formed in the heat exchanger, and a heat conducting medium which flows through the heat exchanger can be cooled.

Use of an axial fan can reduce the brake horsepower of the fan and the fuel expenses of the engine.

Further, the bell-mouth form of the fan surrounding part in the shroud accommodating the fan produces a necessary and sufficient amount of the cooling airflow, even if the rotating speed of the fan is relatively low. Inversely, this means that the rotating speed of the fan can be reduced and thereby the fan noise can be also reduced.

Furthermore, the covering rate of the fan surrounding part is set in the desirable range can optimize the cooling performance of the cooling apparatus with respect to the fan airflow amount and fan noise. The most suitable value of the covering rate of the fan surrounding part is 60 percent.

The axial fan preferably has so-called Y-type blades. This type of fan can reduce the brake horsepower thereof and fuel expenses of the engine.

A clearance between the fan and the shroud can be set to be relatively wide. Namely, the fan surrounding part of the shroud can be formed so as to be relatively wide and therefore the shroud can be installed on the side of the exchanger. This configuration can improve the working efficiency of assembling the cooling apparatus.

The above-mentioned cooling apparatus is desirably used to cool a heat exchanger for an engine mounted on earth-moving/constructing machines. An example of the earth-moving/constructing machine is preferably a hydraulic shovel machine.

From another aspect, the present invention can be understood as a heat exchanger with a shroud having the above-mentioned feature wherein the fan noise is sufficiently low and the cooling performance is sufficiently high. This shroud for the heat exchanger is specifically intended to be used in combination with an axial fan driven by an output shaft of the engine. The axial fan is accommodated within the fan surrounding part of a bellmouth form in the shroud.

BEST MODE FOR CARRYING OUT THE INVENTION

Hereinafter, embodiments of the present invention will be explained in accordance with the accompanying drawings.

Figure 1:
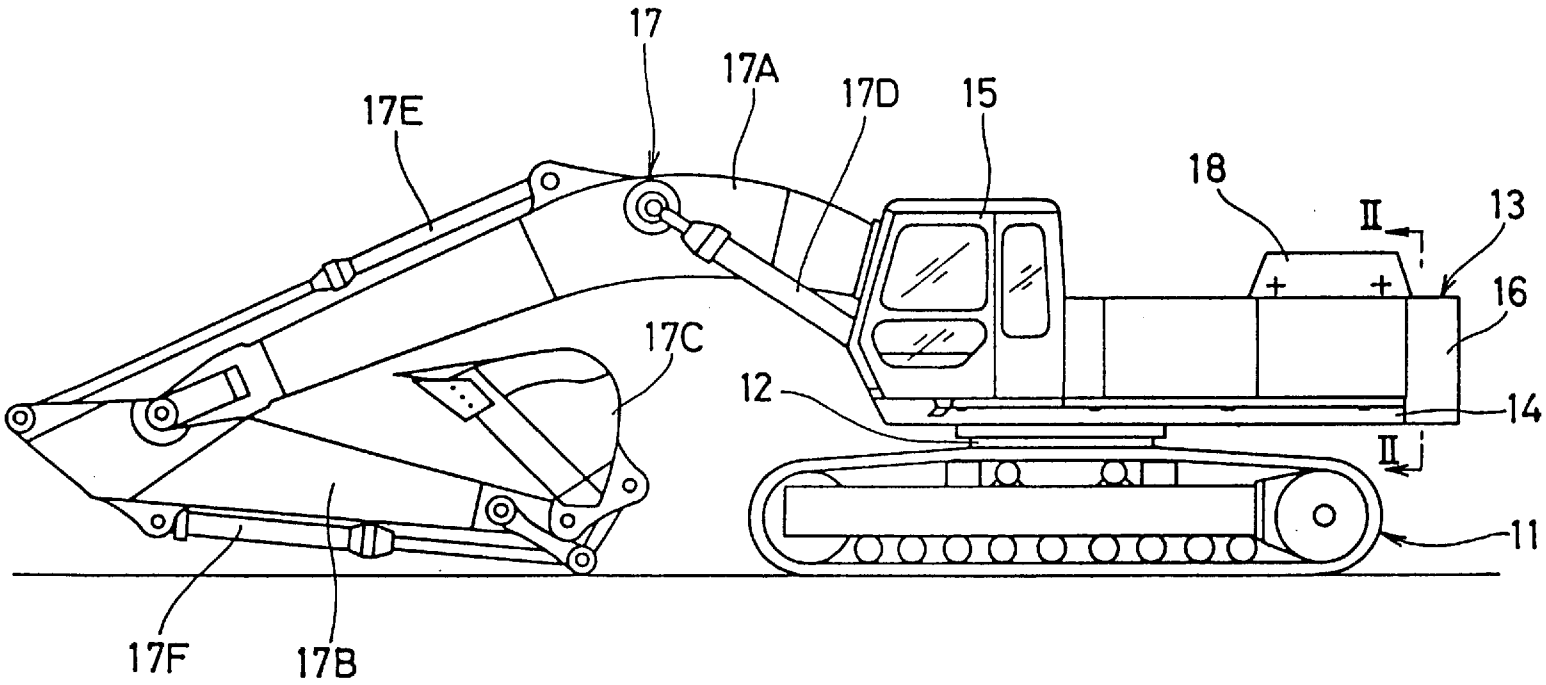
FIG. 1 is a side view showing a hydraulic shovel machine provided with the cooling apparatus for the heat exchanger of the present invention.

A cooling apparatus of the present invention, as shown in FIG. 1, is used for cooling a heat exchanger for an engine of a hydraulic shovel, for example. This hydraulic shovel is provided with a lower travelling body 11 with an oil hydraulic motor for causing the shovel to travel, a rotating unit 12 with an oil hydraulic motor for rotational movement which is equipped to the lower travelling body 11, and an upper rotating body 13 mounted on the lower travelling body 11 rotatable by the rotating unit 12. The upper rotating body 13 acts as a working machine. The upper rotating body 13 is configured with a rotation frame 14 as a basic supporting structure, an operating cabin 15 located in front of the rotation frame 14, a counter weight 16 located in the rear of the rotation frame 14, a working mechanism 17, and a machine chamber 18.

The working mechanism 17 comprises a boom 17A rotatably arranged at the end of the rotation frame 14, an arm 17B rotatably provided at the end of the boom 17A, and a bucket 17C provided at the tapered end of the arm 17B. The boom 17A, the arm 17B, and the bucket 17C can be respectively activated by a boom cylinder 17D, an arm cylinder 17E, and a bucket cylinder 17F.

Figure 2:
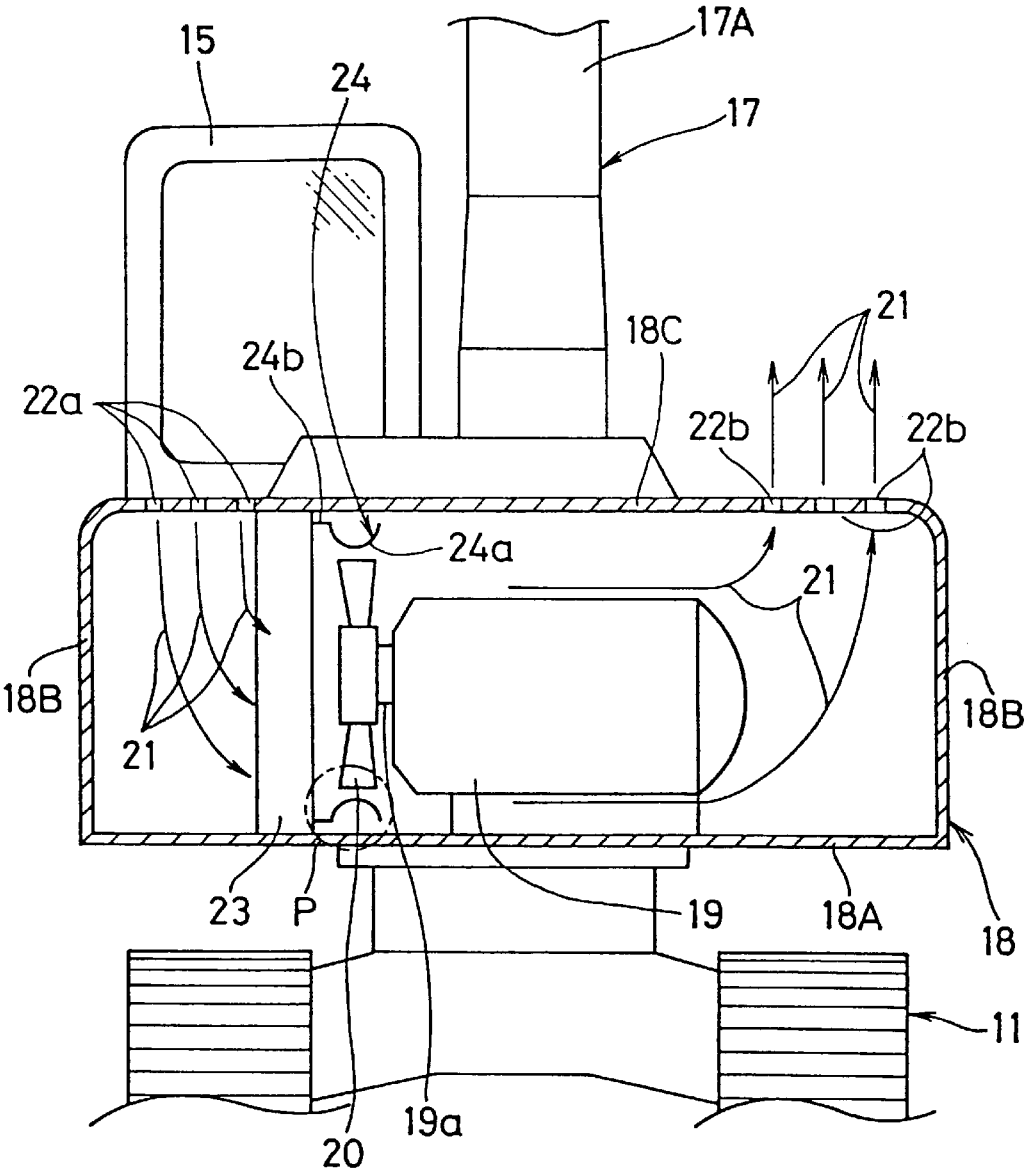
FIG. 2 is a cross-sectional view taken on line II—II of FIG. 1.

The machine chamber 18, as shown in FIG. 2, is formed to be a box-shape with a combination of a bottom plate section 18A, two side plate sections 18B positioned at both sides of the bottom plate section 18A, and a top plate section 18C positioned at an upper side. Further, there are an engine 19, a fan 20 fixed to a rotary output shaft 19*a* of the engine 19, a heat exchanger 23 such as a radiator, and an oil hydraulic pump (not shown) within the machine chamber 18.

In the above-mentioned hydraulic shovel, the oil hydraulic pump located within the machine chamber 18 supplies pressurized oil for each of the oil hydraulic motors used for the lower travelling body 11, the oil hydraulic motor used for the rotation drive unit 12, and the cylinders 17D, 17E and 17F in the working mechanism 17. Thus, the hydraulic shovel performs various actions such as rotation, excavation and the like.

When the fan 20 rotates by the rotating operation of the engine 19, air from outside is introduced to generate an airflow 21 used for cooling. The airflow 21, which is generated on the basis of drawing the air into an inside space through plural openings 22*a* formed in one side (a left side in FIG. 2) of the top plate section 18C, goes forward in a passage formed in the heat exchanger 23, passes through the space around the engine 19, and is discharged to the outside through plural openings 22*b* formed in the other side (a right side in FIG. 2) of the top plate section 18C. Rectifying plates may be arranged in the airflow route in order to lead the air drawn from the openings 22*a* to the heat exchanger 23 and further to lead the air passing in the circumference of the engine 19 to the openings 22*b*.

The heat exchanger 23 is arranged between the openings 22*a* and the engine 19 in the vicinity of the openings 22*a*. The heat exchanger 23 comprises circulation pipes for circulating engine cooling water and many cooling fins provided on the circulation pipes. The circulation pipes are connected to a water jacket of the engine 19 through a supply/drain pipe. The airflow 21 passes through the passages formed in the neighborhood of the cooling fins in the heat exchanger 23. Engine cooling water of high temperature is flowing in the circulation pipes of the heat exchanger 23. The engine cooling water of high temperature can be cooled by the airflow 21. Engine cooling water of low temperature returns to the engine 19 in order to cool it.

A shroud 24 is arranged around the fan 20 so as to surround the fan 20. This shroud 24 comprises a fan surrounding part 24*a* with a bell-mouth form and an edge part 24*b* fixed to the heat exchanger 23. The shroud 24 is installed on the wall of the heat exchanger 23, which exists on the side of the fan 20.

Figure 3A:
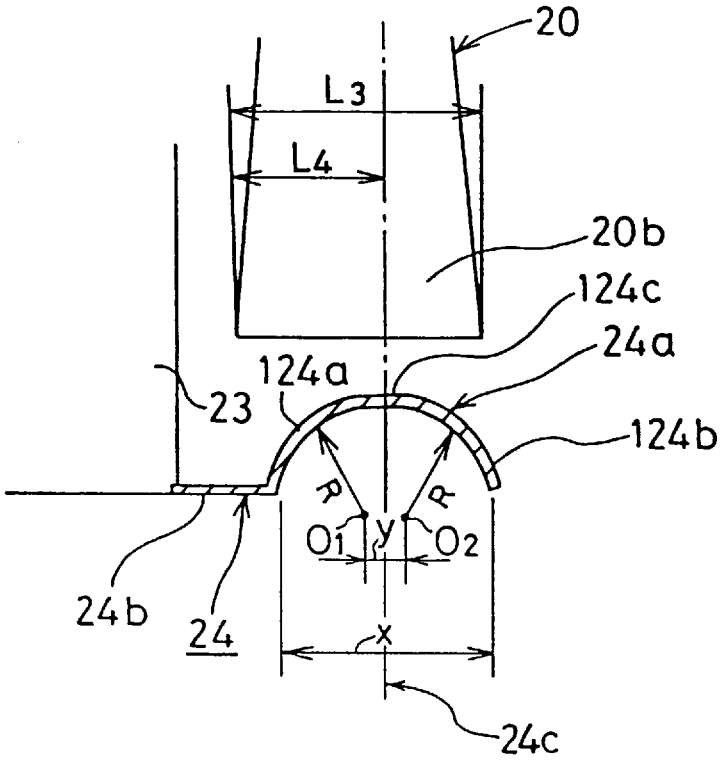
FIG. 3A is an enlarged view showing the part marked as P in FIG. 2.
Figure 3B:
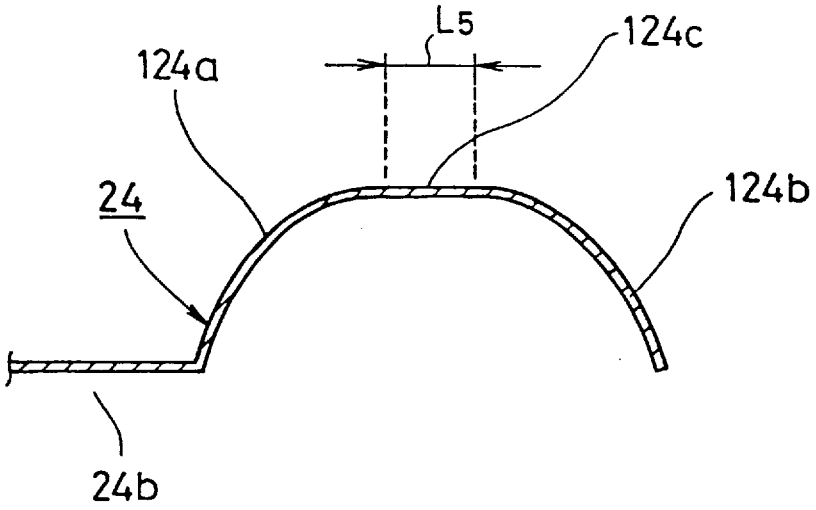
FIG. 3B is an expanded sectional view showing a fan surrounding part of a shroud.
Figure 3C:
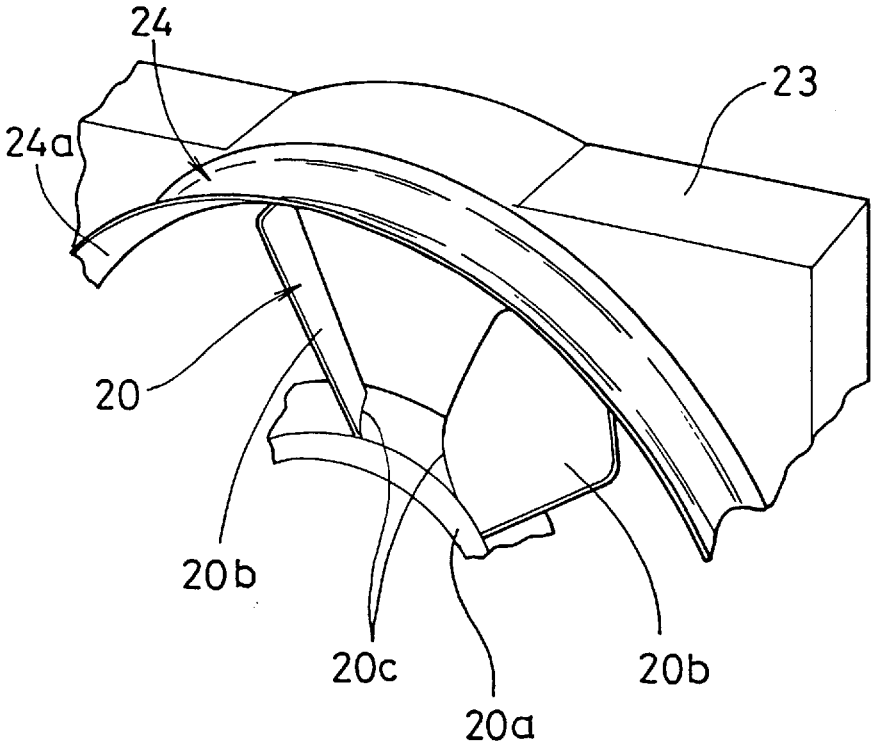
FIG. 3C is a perspective view showing the shroud and the configuration in the neighborhood thereof.
Figure 4:
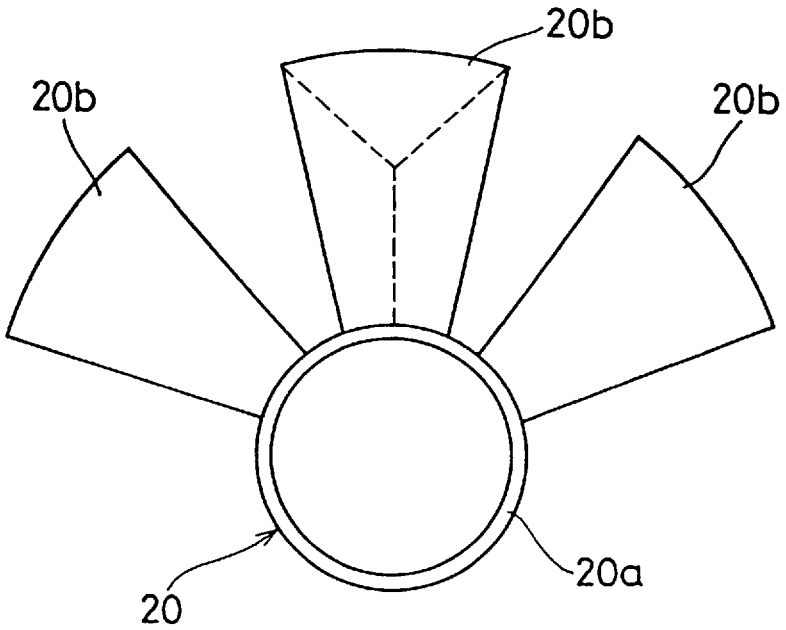
FIG. 4 is a fragmentary front view showing a fan.

Next, the fan 20 and the shroud 24 are explained in detail by referring to FIG. 3A showing an enlarged figure of a portion denoted by reference mark P in FIG. 2, FIG. 3B showing an enlarged main portion in FIG. 3A, FIG. 3C showing a perspective view of an upper portion in the external appearance, and FIG. 4 showing a front view of the fan 20.

As shown clearly in FIG. 4, the fan 20 comprises a hub 20*a* positioned in the center thereof and a plurality of blades 20*b* provided in the external surface of the hub 20*a*. The fan 20 is a type of axial fan. The number of blades 20*b* is desirably six.

Furthermore, the fan 20 is preferably designed to have an angle characteristic with respect to angles between any two neighboring blades of the six blades 20*b*. Namely, the angles between any of their two central lines (a line passing along the central portion of the blade 20*b* from the center of the hub 20*a* to the radial direction as shown in FIG. 4) have alternately two different angle values. Concretely, when the two angle values are defined as θ1 and θ2, for example, the six blades 20*b* are so arranged around the hub 20*a* that the angles between any two neighboring blades are θ1, θ2, θ1, θ2, θ1, θ2 in their arrangement order. The sum of the six angles including θ1 and θ2 becomes 360 degrees.

The external surface of the hub 20*a*, which is cylindrical, is parallel with the axis thereof. As shown in FIG. 4, each of the blades 20*b* can be preferably formed so that the width of the blade which is seen head-on becomes gradually larger in proportion from the hub-side end to the pointed end. Further, a line (a portion 20*c* shown in FIG. 3C) indicating the hub-side end of the blade on the external surface of the hub 20*a*, where the blade is fixed to the hub, is set to have a proportionally curved shape relative to the axis of the hub 20*a*, as shown in FIG. 3C.

The blade 20*b* can be generally referred to as a "Y-type blade" because the shape of the blade 20*b* seen head-on looks like the letter "Y" of the English alphabet as indicated by a broken line in FIG. 4. Further, the fan 20 provided with the plural Y-type blades 20*b* mentioned above is generally referred to as a "Y-type fan". In addition, it is true that the Y-type blade is the most suitable type for the above-mentioned blade 20*b*, but the blade 20*b* is not necessarily limited to the Y-type blade.

The shroud 24 comprises the fan surrounding part 24*a* set to be close to the pointed end of the blade 20*b* and the edge part 24*b* fixed on the heat exchanger 23, as shown in FIGS. 3A and 3C. The fan surrounding part 24*a* and the edge part 24*b* are made out of one part to form the shroud 24. The fan surrounding part 24*a* is also formed to be a bell-mouth form as mentioned above. To explain more specifically, as is clear in the lower cross-sectional shape of the fan surrounding part 24*a* shown in FIG. 3B, it comprises two arc parts 124*a* and 124*b* with the radius of R and a straight part 124*c* (with length $L_5$) between the two arc parts. The two arc parts 124*a* and 124*b* have the same cross section shape. For the fan surrounding part 24*a* with the bell-mouth form, the diameter is the largest at both ends thereof and the diameter towards the middle of straight part 124*c* becomes gradually smaller in proportion as it approaches the center of the fan surrounding part 24*a* in its axial direction. Accordingly, the central portion of the fan surrounding part 24*a* in its axial direction is drawn towards its inside. The shroud 24 is designed so that the diameter of the shroud 24 is as small as possible at the straight part 124*c*. In addition, reference numeral 24*c* designates the central line of the shroud, which is set to pass at a central position of the straight part 124*c* in the fan surrounding part 24*a*. Further, the edge part 24*b* is so fixed to the fan-side wall surface of the heat exchanger 23 that it covers air passing openings formed in the wall surface.

Specific conditions stated as in the following are established with respect to a positional relationship between the blades 20*b* of the fan 20 and the fan surrounding part 24*a* of the shroud 24 shown in FIG. 3A.

Figure 5:
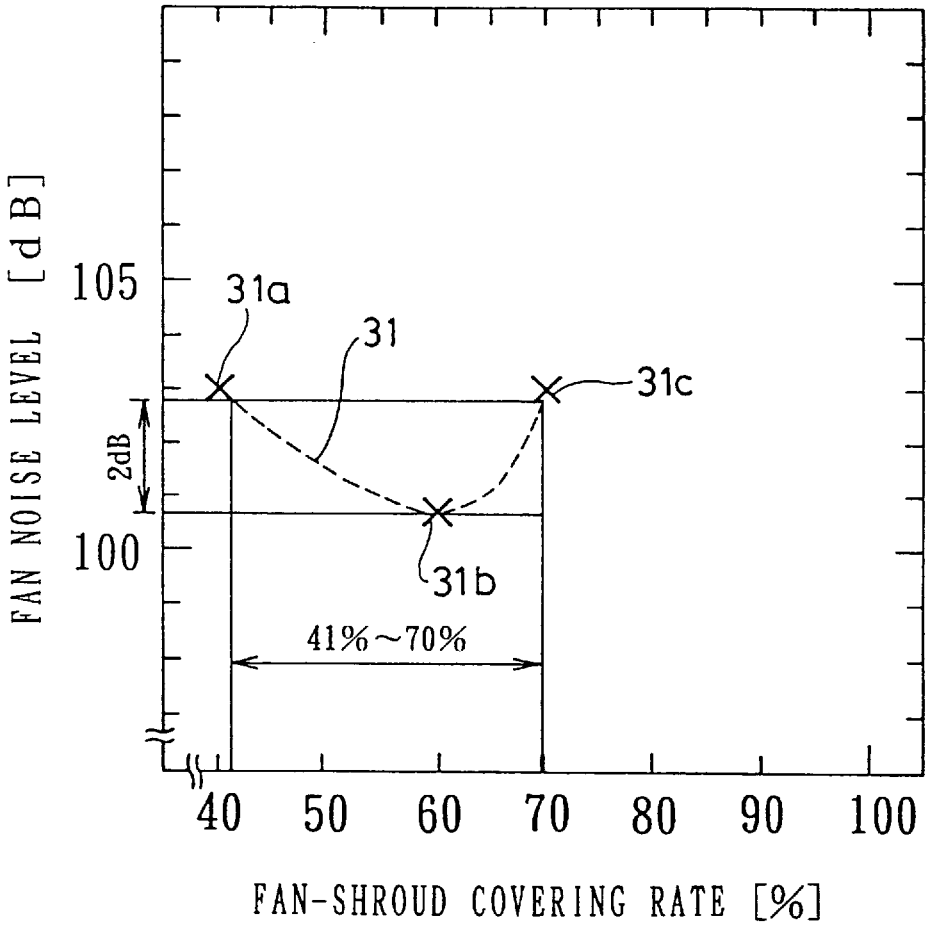
FIG. 5 is a graph showing a relationship between a covering rate and fan noise with respect to the embodiment of the present invention.

In FIG. 3A showing a side view, with the width (the width shown from the side) of a blade tip end denoted as $L_3$and the distance from a blade edge located on the side of the heat exchanger to the central line 24*c* of the shroud denoted as $L_4$, a covering rate is defined as $L_4/L_3$ (expressed by a ratio directly or by a percentage (%) after multiplying by one hundred). With respect to the covering rate, when conducting a simulation test of fan noise simulating the operation of the actual machine by changing the covering rate in the range from about 0 percent to about 100 percent, a test result shown in FIG. 5 was obtained. In a graph shown as the test result, the horizontal axis indicates the covering rate of the shroud and the vertical axis indicates the fan noise (dB). In a fan-noise characteristic 31 shown in FIG. 5, the fan noise become lowest (shown at a point 31*b*) when the covering rate is approximately 60%, and therefore the covering rate of 60% is the optimum. The fan noise at the point 31*b* is about 100.7 dB. Furthermore, when considering a covering rate range corresponding to a fan noise range including a fan noise volume which is within 2 dB of point 31*b*, the difference being indistinguishable for human ears, the covering rate range including the optimum covering rate of 60% is equal to the range from a lower covering rate obtained by subtracting 19% from 60% to an upper covering rate obtained by adding 10% to 60%. Namely, the covering rate range suitable for lowering the fan noise due to the rotation of the fan 20 proves to be the range of 41–70% approximately corresponding to an interval between points 31*a* and 31*c* shown in FIG. 5. The value of the fan noise at the points 31*a* and 31*c* is about 103 dB.

Measurements of the most suitable shroud 24 are as follows. As shown in FIG. 3A, when setting the width of the fan surrounding part 24 to be x, a distance between a center $O_1$ of a circle including the arc part 124*a* and a center $O_2$ of a circle including the arc part 124*b* to be y, and a radius of the two circles to be R, $x=0.83L_3$, $y=0.083x$, and $R=0.5x$. These most suitable measurements correspond to the shroud having the optimum covering of 60%. When considering the most suitable measurements of the shroud 24 in view of the covering rate range 41–70%, it is desirable that $0.6L_3 \leqq x \leqq 1.1L_3$, $0 \leqq y \leqq 0.25x$, and $0.4x \leqq R \leqq 0.7x$. When y=0, the above-mentioned straight part 124*c* does not exist in the fan surrounding part 24*a*. Therefore, the straight part 124*c* is not always required.

When the straight part 124*c* is formed in the fan surrounding part 24*a*, however, the shroud 24 has an advantage that a smooth flow of air without turbulence can be produced, because the straight part 124*c* can regulate the airflow directed to the outlet.

Further, the fan surrounding part 24*a* of the present embodiment, which has the bell-mouth form, can sufficiently produce an excellent fan characteristic without decreasing the gap between the fan 20 and the fan surrounding part 24*a*, or the clearance, unlike the above-mentioned conventional second example. Accordingly, the clearance can be increased in comparison with the conventional second example, and therefore the degree of freedom in designing the connection of the shroud 24 to the heat exchanger 23 and in addition the shroud 24 can be installed on the side of the heat exchanger 23. The installation of the shroud 24 in the heat exchanger 23 does not cause any problems even if there are some errors with respect to the installation positions of the heat exchanger 23 and the engine 19, because the clearance can be relatively wide.

Next, advantages of the cooling apparatus for the heat exchanger in accordance with the present embodiment will be explained from various view points by referring to FIGS. 6–8.

Figure 6:
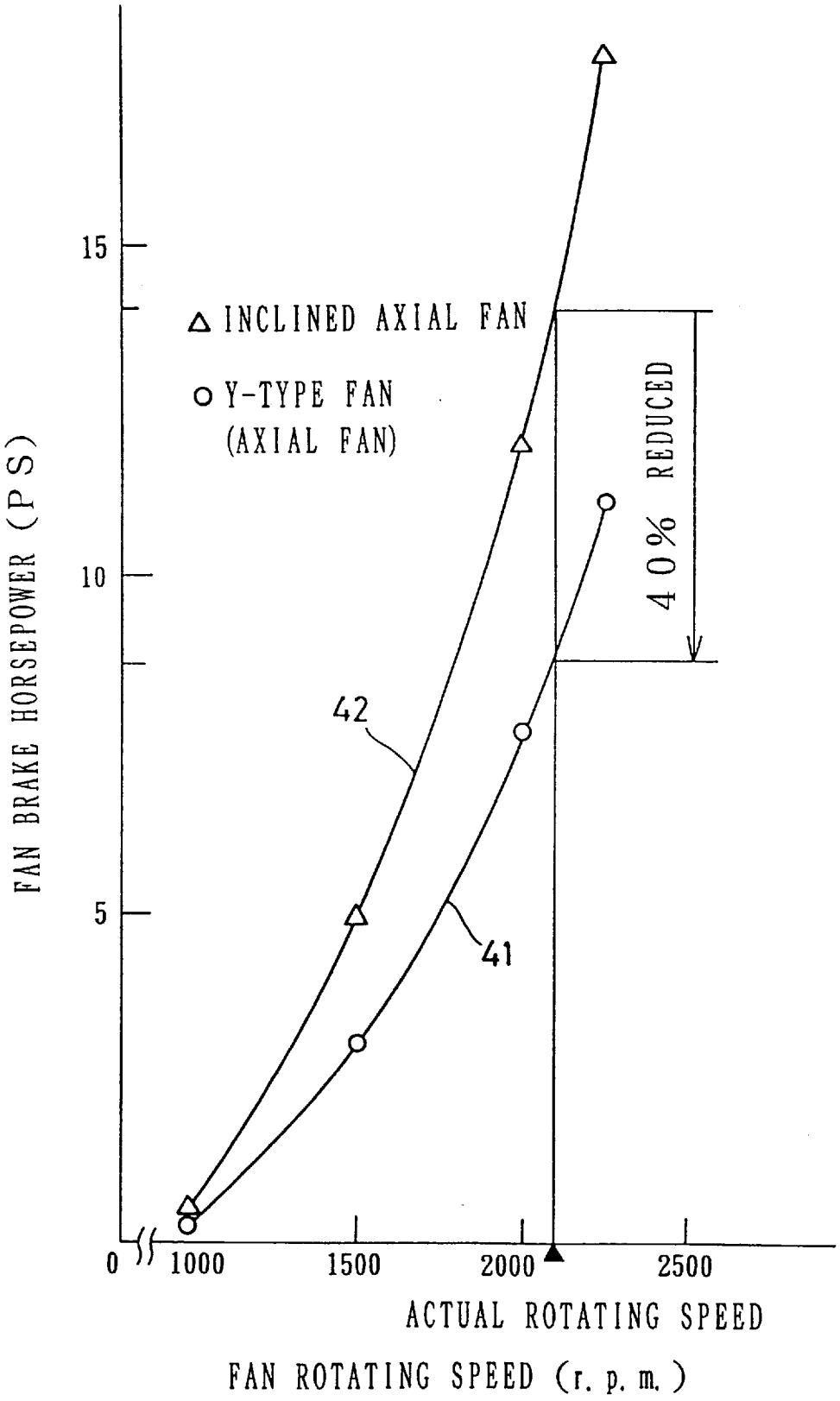
FIG. 6 is a graph showing a relationship between brake horsepower and fan rotating speed with respect a Y-type fan and an inclined axial fan.

FIG. 6 shows a comparison between the Y-type fan (the axial fan) and the inclined axial fan with respect to the relation between a fan rotating speed (r.p.m.) and a fan brake horsepower (PS). In FIG. 6, the horizontal axis indicates the fan rotating speed and the vertical axis indicates the fan brake horsepower. Further, reference numeral 41 denotes the behavior of the Y-type fan and reference numeral 42 denotes the behavior of the inclined axial fan. As is clear by comparing the two behavior characteristics 41 and 42, the fan brake horsepower of the Y-type fan is reduced to be less than that of the inclined axial fan. For example, with respect to an actual fan rotating speed when using the Y-type fan, the fan brake horsepower thereof can be reduced by 40% in comparison with the case of using the inclined axial fan. Thus, the cooling apparatus for the heat exchanger in accordance with the present embodiment can reduce the fan brake horsepower so as to reduce the fuel expenses of the engine by using the Y-type fan 20 for the cooling apparatus.

Figure 7:
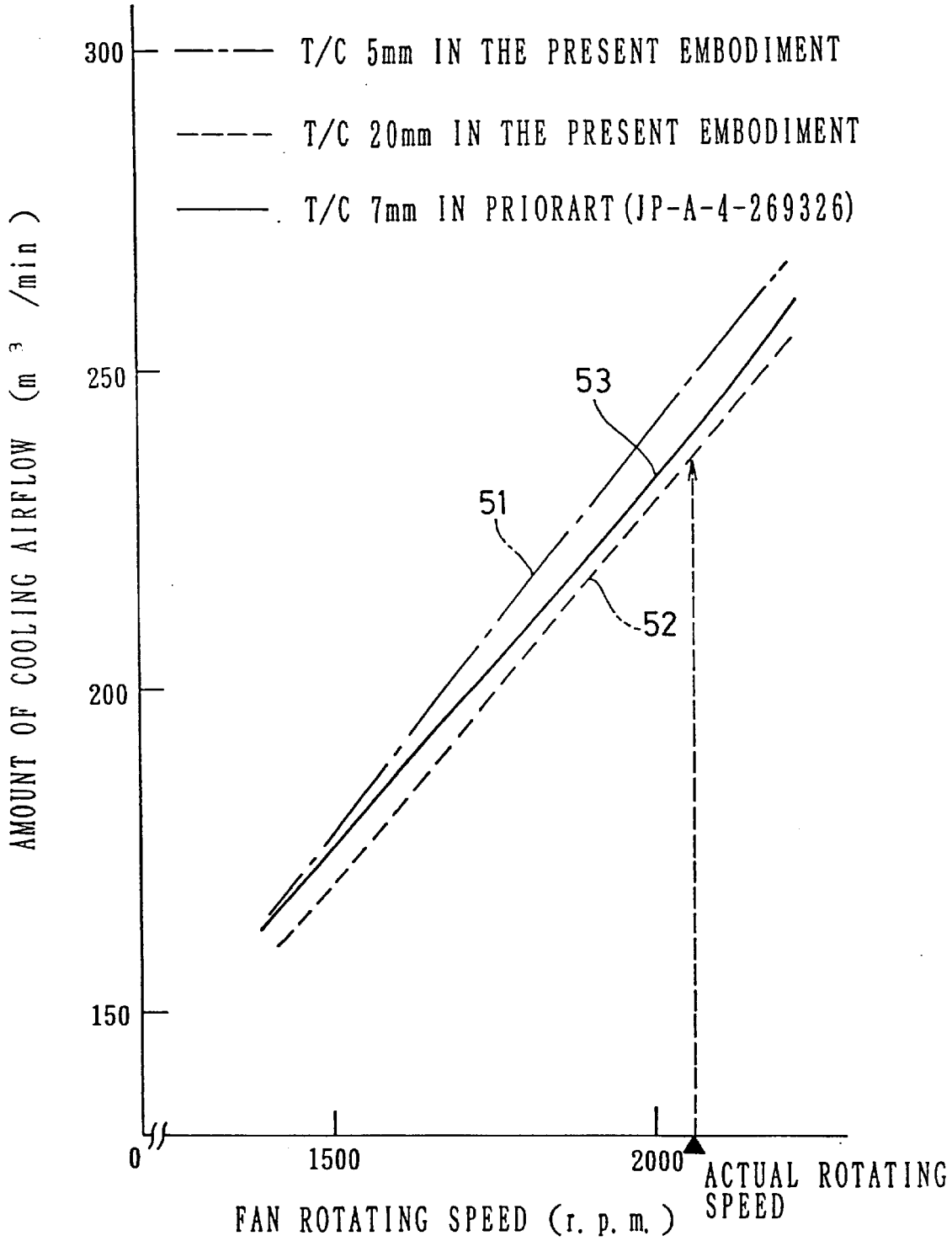
FIG. 7 is a graph showing a relationship between fan rotating speed and cooling airflow amount in view of a chip clearance with respect to the apparatus of the embodiment and the conventional apparatus.

FIG. 7 shows an advantage with respect to the clearance in the cooling apparatus for the heat exchanger in accordance with the present embodiment. This figure shows the comparison between the present embodiment and the technology disclosed in JP-A-269326. In FIG. 7, the horizontal axis indicates the fan rotating speed (r.p.m.) and the vertical axis indicates an amount of a cooling airflow ($m^3$/min). Line 51 is for the cooling apparatus of the present embodiment in which the clearance, abbreviated T/C for "tip clearance" is 5 mm, line 52 is for the same apparatus in which the tip clearance (T/C) is 20 mm, and line 53 is for the conventional cooling apparatus in which the clearance is 7 mm. As shown clearly in this figure, when comparing the cooling apparatus of the present embodiment with a clearance of 20 mm and the conventional cooling apparatus with a clearance of 7 mm, though the conventional apparatus is better than the apparatus of the present embodiment by about 1% at the actual fan rotating speed close to 2000 r.p.m., both apparatuses prove to have substantially equivalent cooling performance as a whole. Thus, the cooling apparatus of the present embodiment used for the heat exchanger can achieve practical and high enough cooling performance even if the clearance is relatively wide. Further, since the clearance can be widened in the cooling apparatus of the present embodiment, the shroud 24 can be installed on the side of the heat exchanger 23 as mentioned above. This configuration brings out the advantages that a working efficiency of assembling the cooling apparatus can be improved and a production cost can be reduced.

Figure 8:
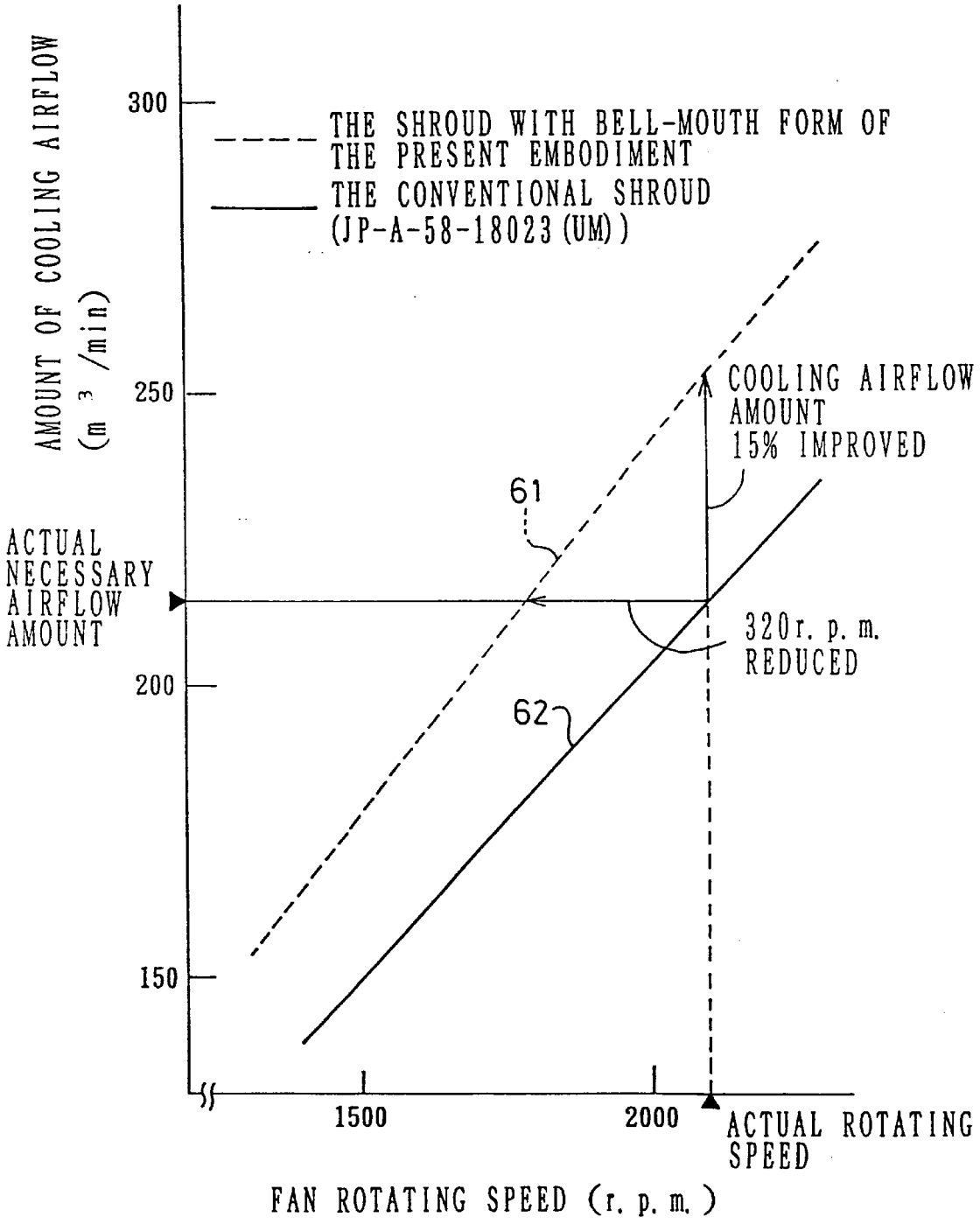
FIG. 8 is a graph showing a relationship between fan rotating speed and cooling airflow amount with respect to the shroud of the embodiment and the conventional shroud.
Figure 9:
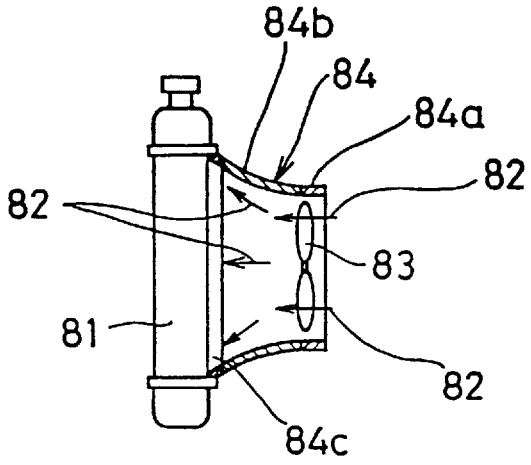
FIG. 9 is a side view with a partially sectional view showing the first conventional example.
Figure 10:
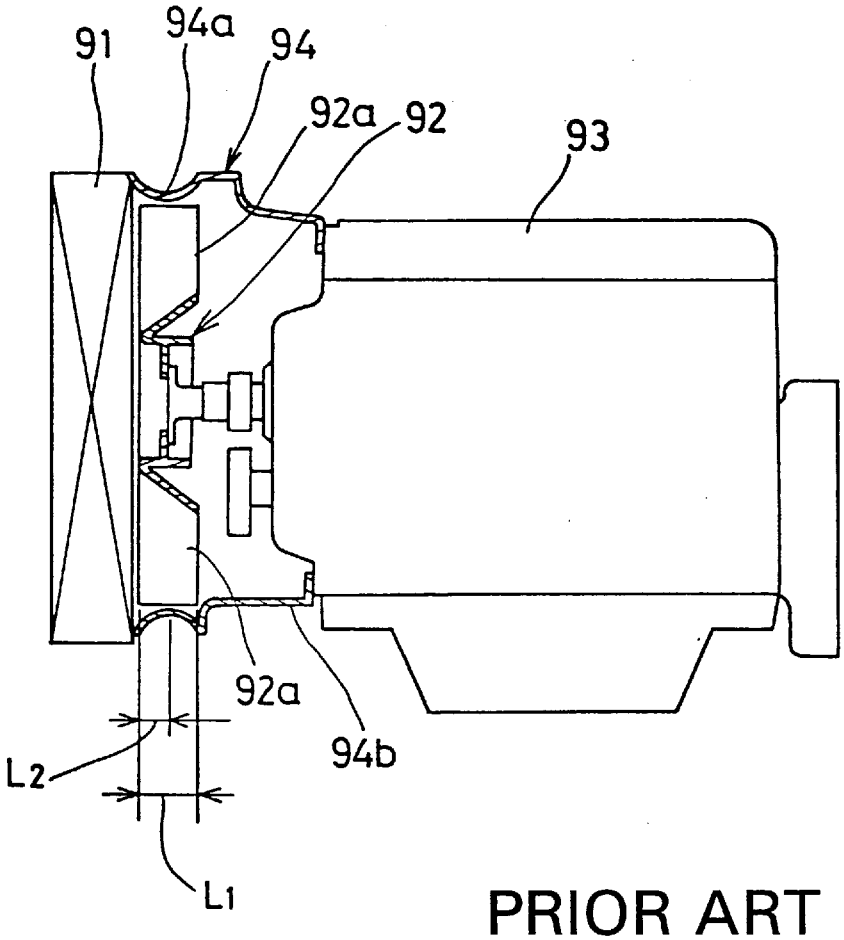
FIG. 10 is a side view with a partially sectional view showing the second conventional example.

FIG. 8 shows a relationship between the fan rotating speed and the amount of the cooling airflow with respect to both the cooling apparatus with the shroud 24 with the fan surrounding part 24*a* of bell-mouth form in accordance with the present embodiment, and the cooling apparatus with the shroud disclosed in JP-A-58-18023 (UM). In this figure, reference numeral 61 denotes the behavior of the cooling apparatus of the present embodiment, and reference numeral 62 denotes the behavior of the conventional cooling apparatus. As is clear in the figure, when comparing values in both the behavior characteristics at the actual fan rotating speed, for example, the cooling apparatus of the present embodiment can be improved by 15% over the conventional cooling apparatus. Further, when comparing both characteristics based on the criterion of using an actually required amount of airflow, the cooling apparatus of the present embodiment has an advantage such that the fan rotating speed can be reduced by 320 r.p.m. in order to obtain the amount of the airflow the same as that for the conventional cooling apparatus. Accordingly, the reduction in the fan rotating speed in accordance with the present invention can reduce volume of fan noise. Furthermore, a quantitative relationship between the fan rotating speed and the fan noise volume can be formulated by $M_2=M_1+55 \log N_2/N_1$, which is similar to the formula for the axial fan. In this formula, $M_2$ and $M_1$ indicate the fan noise volume on two similar fans and $N_2$and $N_1$ indicate the fan rotating speed for similar fans. According to the formula, when decreasing the fan rotating speed, the fan noise volume can be also decreased.

As clarified according to the above-mentioned description, in the apparatus used for cooling the heat exchanger for the engine mounted on the hydraulic shovel, for example, with respect to a configuration of cooling a heat conducting medium which flows through the heat exchanger by rotating the fan to produce the cooling airflow which passes through air passages of the heat exchanger, the brake horsepower of the fan can be decreased together with the reduction of the fuel expenses of the engine because the axial fan with the Y-type blades is preferably used as the fan.

Even if the fan rotates at a relatively low rotating speed, the necessary and sufficient amount of the cooling airflow can be obtained, because the fan surrounding part of the shroud, which accommodates the fan, is formed to have the bell-mouth form. This structure reduces the rotating speed and noise level of the fan.

Further, since the covering rate of the fan surrounding part is set to be the above-mentioned desirable values, the cooling performance of the cooling apparatus can be optimized with respect to the fan airflow amount and fan noise.

With respect to the configuration of the fan surrounding part of the shroud, since the chip clearance can be relatively wide, the shroud can be installed on the side of the heat exchanger, and thereby the assembling work efficiency can be increased and the production cost can be decreased.

Furthermore, the cooling apparatus of the heat exchanger can be applied to other earth-moving/constructing machines besides the hydraulic shovel machine.

INDUSTRIAL APPLICABILITY

The cooling apparatus is applied to the heat exchanger attached to the engine mounted on earth-moving/constructing machines such as the hydraulic shovel and the like. This cooling apparatus can maximize its cooling performance and reduce the fuel expenses of the engine, and the work efficiency of assembling the apparatus can be increased and the production cost thereof can be decreased.

We claim:

1. A cooling apparatus for a heat exchanger installed on an engine, comprising a fan for generating an airflow cooling the heat exchanger which is rotated by said engine, and a shroud having a central line for accommodating said fan, which is installed on said heat exchanger, wherein said fan is a type of axial fan having Y-type blades, and said shroud has a fan surrounding part with a bellmouth form covering said Y-type blades so that a clearance is formed between said fan surrounding part and each tip of said Y-type blades, and a covering rate of said fan surrounding part lies in a range of 41 percent to 70 percent, wherein said covering rate is a ratio expressed in a percentage of the distance from the blade edge disposed adjacent the heat exchanger and extending to the central line of the shroud to the width of a blade tip end.

2. A cooling apparatus for a heat exchanger as claimed in claim 1, wherein an optimum value with respect to said covering rate of said fan surrounding part is 60 percent.

3. A cooling apparatus for a heat exchanger as claimed in claim 1, wherein said clearance between said fan and said shroud is set to be relatively wide.

4. A cooling apparatus for a heat exchanger as claimed in claim 1, wherein said fan surrounding part with the bell-mouth form has two arc parts respectively positioned at sides of said heat exchanger and said engine.

5. A cooling apparatus for a heat exchanger as claimed in claim 4, wherein said two arc parts have same shape in their cross section.

6. A cooling apparatus for a heat exchanger as claimed in claim 4, wherein said fan surrounding part has a straight part between said two arc parts, and a clearance is formed between said straight part and each tip of said Y-type blades.

7. A cooling apparatus for a heat exchanger as claimed in claim 1, wherein said engine is mounted on an earth-moving/constructing machine.

8. A cooling apparatus for a heat exchanger as claimed in claim 7, wherein said earth-moving/constructing machine is a hydraulic shovel machine.

9. A cooling apparatus for a heat exchanger as claimed in claim 3, wherein said clearance is larger than 7 mm and not larger than 20 mm.

10. A cooling apparatus for a heat exchanger installed on an engine, being configured as a combination of the heat exchanger provided with a shroud having a central line having a fan surrounding part formed to be in a bell-mouth form, and an axial fan having Y-type blades driven by an output shaft of said engine, wherein said axial fan is accommodated within said fan surrounding part so that a clearance is formed between said fan surrounding part and each tip of said Y-type blades and a covering rate of said surrounding part lies in a range of 41 percent to 70 percent, wherein said covering rate is a ratio expressed in a percentage of the distance from the blade edge disposed adjacent the heat exchanger and extending to the central line of the shroud to the width of a blade tip end.

11. A heat exchanger comprising a shroud having a fan surrounding part of a bell-mouth form, which is combined with an axial fan having Y-type blades so that said fan surrounding part accommodates said axial fan, said shroud having a central line, and when combining said fan surrounding part and said axial fan, a covering rate of said fan surrounding part lies in a range of 41 percent to 70 percent, wherein said covering rate is a ratio expressed in a percentage of the distance from the blade edge disposed adjacent the heat exchanger and extending to the central line of the shroud to the width of a blade tip end.

* * * * *